United States Patent [19]

Immel

[11] 4,238,756

[45] Dec. 9, 1980

[54] ELECTRIC RESISTANCE UNIT

[75] Inventor: Ralph B. Immel, Williamsville, N.Y.

[73] Assignee: Westinghouse Electric Corp., Pittsburgh, Pa.

[21] Appl. No.: 974,176

[22] Filed: Dec. 28, 1978

[51] Int. Cl.[3] ..... H01C 7/22

[52] U.S. Cl. ..... 338/304; 338/278; 338/321

[58] Field of Search ..... 338/278, 267, 270, 304, 338/296, 321

[56] References Cited

U.S. PATENT DOCUMENTS

| | | | |
|---|---|---|---|
| Re. 22,313 | 5/1943 | Britton et al. | 338/278 |
| 1,550,640 | 8/1925 | Whittingham | 338/278 |
| 1,550,641 | 8/1925 | Whittingham | 338/278 |
| 1,728,090 | 9/1929 | Whittingham | 338/278 X |
| 2,390,790 | 12/1945 | Immel et al. | 338/278 X |
| 4,001,761 | 1/1977 | Liebler et al. | 338/278X |
| 4,028,793 | 6/1977 | Liebler et al. | 29/618 |

*Primary Examiner*—C. L. Albritton
*Attorney, Agent, or Firm*—L. P. Johns

[57] ABSTRACT

An electric resistance unit characterized by a support rod with a plurality of insulating refractory bodies thereon, which bodies have grooves to fit the rod, a continuous resistance winding mounted around the bodies, and flexible metal mounting means in the groove and between the rod and the bodies for retaining the bodies on the rod.

10 Claims, 11 Drawing Figures

ELECTRIC RESISTANCE UNIT

BACKGROUND OF THE INVENTION

1. Field of the Invention

This invention relates to electrical resistors and, more particularly, to resistor units for use in motor starters or other electric apparatus which are exposed to moderate vibration and industrial environment.

2. Description of the Prior Art

Electric resistance units of prior construction have required strips of asbestos dipped in a water glass solution to mount the porcelain insulators on a steel support bar. Since steel and porcelain are rigid materials, it was necessary to provide padding between them to hold them together during subsequent winding of a helical resistor element around the assembled bar and insulators. The asbestos strips also prevented the bar and insulators from subsequently rattling.

Inasmuch as asbestos is detrimental to people's health, it has been deemed desirable to replace the asbestos strips with a non-detrimental material.

SUMMARY OF THE INVENTION

In accordance with this invention, it has been found that a more desirable resistor unit is available which comprises an elongated support rod, a plurality of insulating refractory bodies on the rod in end-to-end abutment and arranged to substantially surround the rod, the bodies being of shorter length than the rod, each body having a groove to fit the rod, a continuous resistance winding helically mounted on and surrounding the refractory bodies, flexible metal mounting means in the groove and between the rod and the bodies for retaining the bodies on the rod, the insulator mounting means comprising corrugated strips of metal having alternate ridges and grooves with the grooves adjacent to the support rod, the ends of the ridges being beveled or the end portions being formed inwardly to provide inwardly inclined ends to facilitate assembly of the bodies on the rod, and water glass adhesive being disposed between the rod and the bodies.

The advantage of the device of this invention is that the corrugated or formed spring strips not only provide a flexible mounting means for relatively fragile ceramic insulators, but also eliminate the current asbestos padding now used to secure insulators on the mounting bar.

DESCRIPTION OF THE PREFERRED EMBODIMENTS

Figure 1:
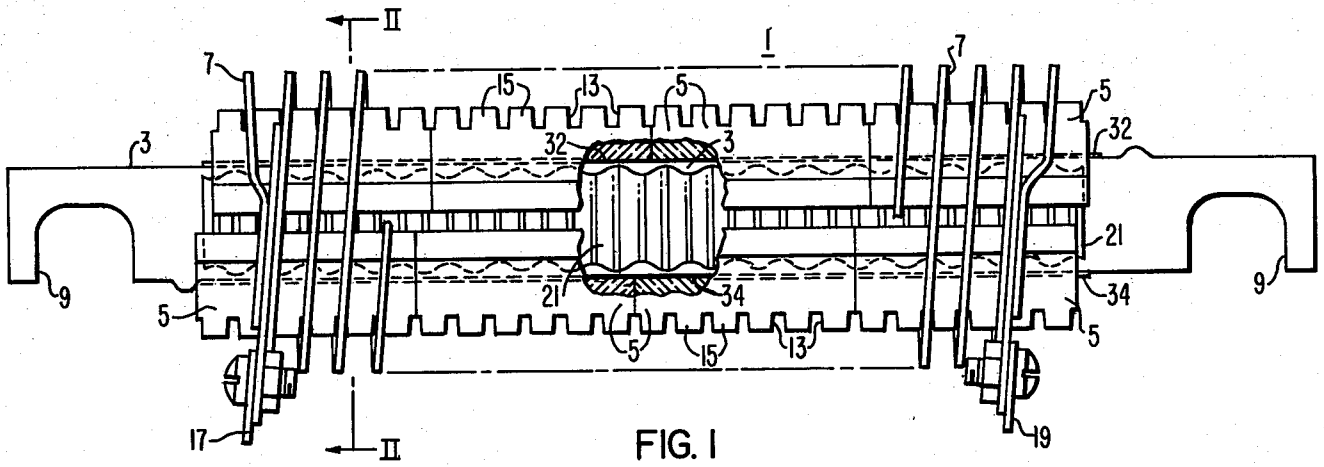
FIG. 1 is an elevational view of an electric resistor unit in accordance with this invention.

In FIG. 1, an electric resistor unit assembly is generally indicated at 1, and it comprises an elongated support rod or strap 3, a plurality of insulating refractory bodies 5, and a helical resistance winding or conductor 7. The unit is adapted for mounting on support bars in a conventional manner for which reason the support rod 3 comprises similar hooks or slots 9 for facilitating the mounting.

The rod 3 is an elongated strap having a rectangular cross section (FIG. 2) and is preferably comprised of a suitable heat resisting metal.

Figure 2:
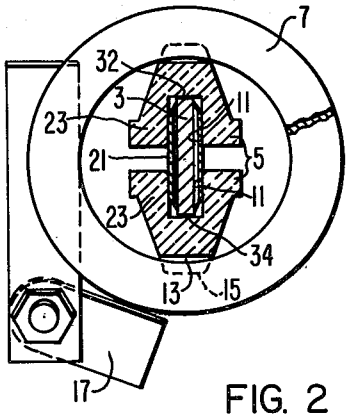
FIG. 2 is a vertical sectional view taken on line II—II of FIG. 1.
Figure 11:
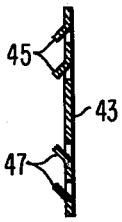
FIG. 11 is a vertical sectional view taken on line XI—XI of FIG. 10.

The insulators or refractory bodies 5 are molded members of ceramic material such as porcelain. Each refractory body 5 has a transverse U-shaped cross section forming a longitudinal slot 11. As shown in FIG. 2, the rod fits into the slots 11 on upper and lower sides thereof so that the rod is substantially enclosed within the slots 11 which are disposed in facing relationship on the rod so that the rod is substantially contained within the refractory bodies 5. The bodies 5 are disposed longitudinally in end-to-end abutment with each other over the length of the rod 3. Moreover, the upper and lower edges of each pair of oppositely-disposed bodies 5 include suitable spaced notches 13 which are separated by projections 15 to provide a threaded support for the helical resistor winding 7.

Figure 3:
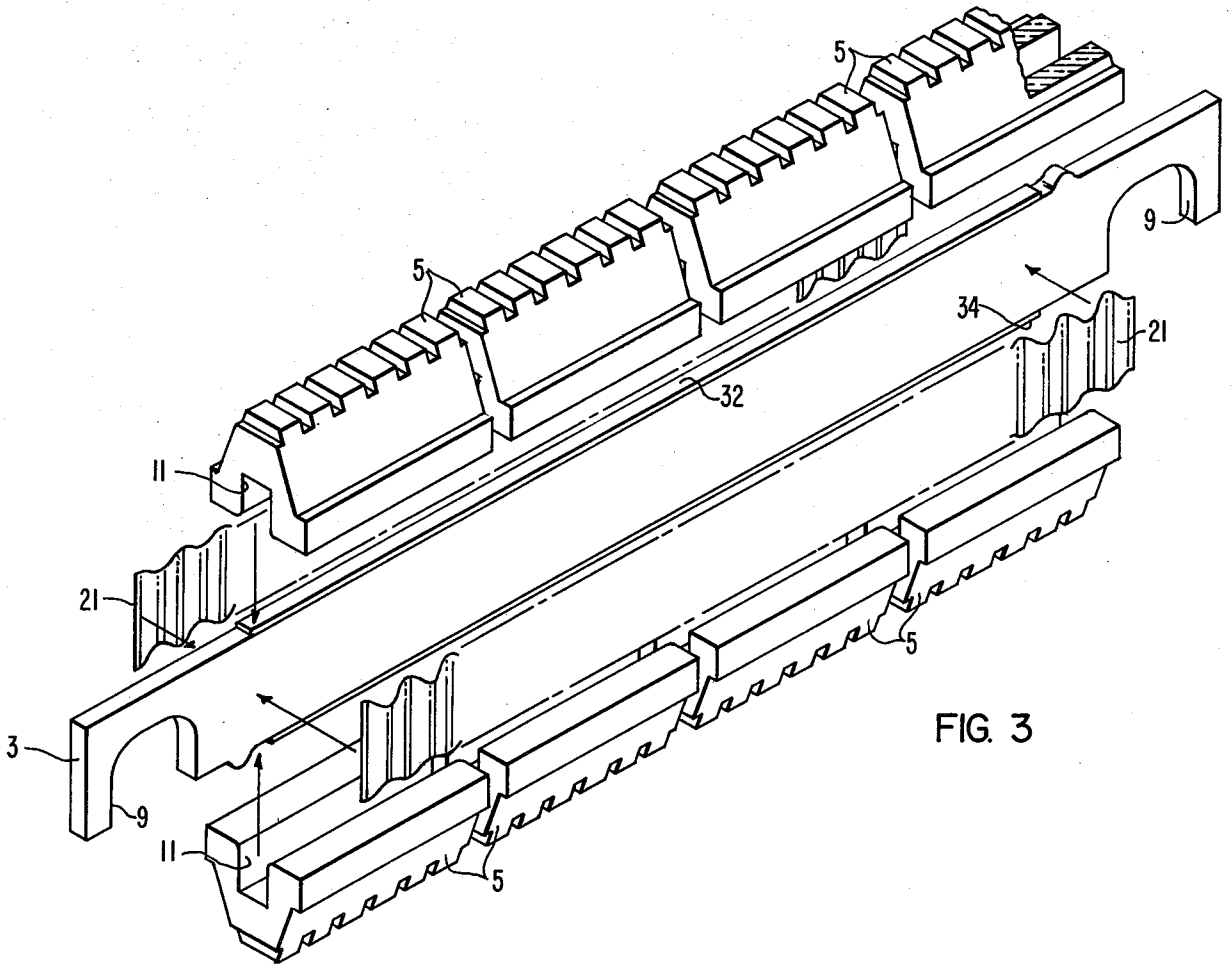
FIG. 3 is an exploded view showing the manner in which the unit is assembled.

When the refractory bodies 5 are assembled on the rod 3 in the manner shown in FIG. 3, the assembly is then rotated on the longitudinal axis of the rod to assemble the resistance winding 7 by threading it through the notches 13. Terminals 17, 19 (FIG. 1) are provided for making electrical connections to opposite ends of the winding 7.

Figure 4:
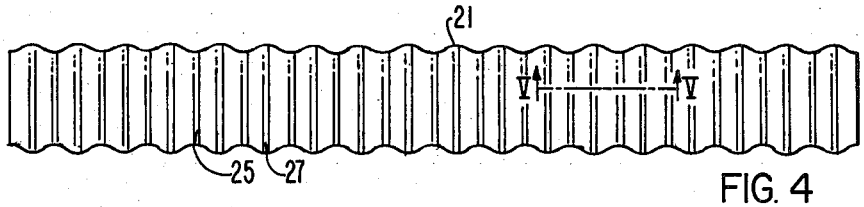
FIG. 4 is a plan view of a strip of corrugated sheet metal.
Figure 5:
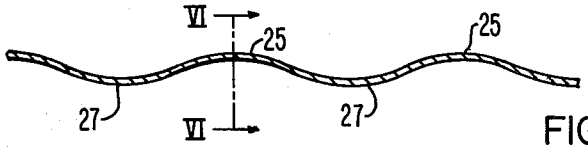
FIG. 5 is an enlarged fragmentary view taken on the line V—V of FIG. 4.
Figure 6:
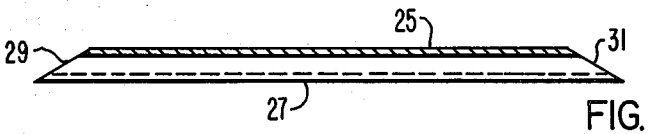
FIG. 6 is a vertical sectional view taken on the line VI—VI of FIG. 5.

In accordance with this invention, a formed metal strip 21 is disposed in the slot 11 in the space between the rod 3 and the sidewalls 23 of the refractory bodies 5 forming the slots 11. The metal strip 21 is disposed preferably on each side of the rod 3 for securing the bodies 5 in place on the rod. More particularly, each metal strip 21 is a flexible member having a non-planar configuration to create friction between the rod and the bodies 5, thereby preventing the bodies from falling off of the rod inadvertently. As shown in FIGS. 4 and 5, the metal strips 21 may have a sinuous or corrugated configuration with alternate ridges 25 and grooves 27 so that the strips 21 are compressed between the rod and the sidewalls 23 of the refractory bodies 5.

To eliminate any difficulty of inserting the bodies 5 onto the rod 3 due to sharp corners at opposite ends of the ridges 25, the opposite edges of the metal strip 21 may be ground to beveled edges 29, 31. The grooves 27 are thereby placed against the sides of the rod 3 with the ridges 25 against the sidewalls 23 of the bodies 5.

During the moderately high speed rotation of the assembled rod 3 and bodies 5 when the resistance winding 7 is threaded in place around the assembly, centrifugal force may be sufficiently great to cause some of the bodies to slip out of place or fly off of the rod. Accordingly, strips 32, 34 (FIGS. 2, 3) of adhesive material are applied on edges in the longitudinal space between the bodies 5. A suitable adhesive material 32, 34 for that purpose is a water glass solution.

Figure 7:
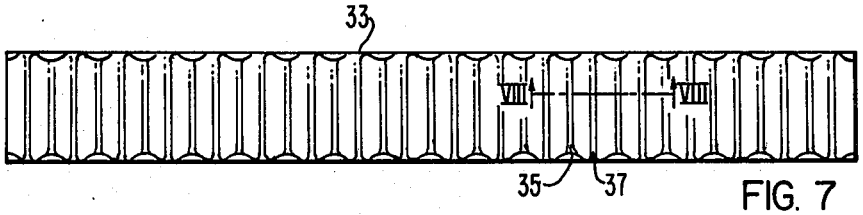
FIG. 7 is a plan view of corrugated sheet metal of another embodiment.
Figure 8:
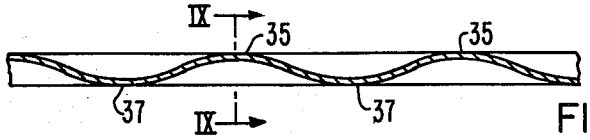
FIG. 8 is an enlarged fragmentary view taken on the line VIII—VIII of FIG. 7.
Figure 9:
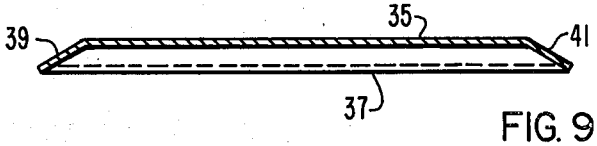
FIG. 9 is a vertical sectional view taken on the line IX—IX of FIG. 8.

In FIGS. 7, 8, and 9, another embodiment of a metal strip 33 is shown. The strip 33 also includes alternate ridges 35 and grooves 37 similar to the strip 21. However, the strip 33 instead of having ground beveled edges 29, 31 are provided with formed or bent-in edges 39, 41 (FIG. 9) to facilitate the mounting of the refractory bodies 5 onto the rod 3.

Figure 10:
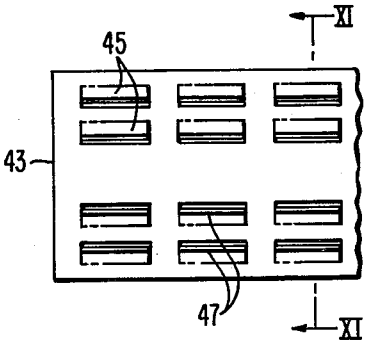
FIG. 10 is a plan view of another embodiment of the metal strip.

Another embodiment of a metal strip 43 is shown in FIG. 10 in which at least one and preferably two or more rows of lanced projections 45 are provided along one edge of the metal strip 43 and another set or rows of lanced projections 47 are provided on the other side thereof. The projections 45, 47 are disposed at angles less than 90° and preferably 80° to the surface of the strip 43. Accordingly, when the refractory bodies 5 are in place, the shart edge, lanced projections 45, 47 deflect to retain them in place on the rod 3.

In conclusion, the device of this invention provides suitable means for mounting the refractory bodies in place on the metal rod which mounting means are flexible and disposed between the rigid, unyielding rough surfaces of the rod and bodies. The flexible mounting means eliminate the use of objectionable asbestos padding and prevent the bodies from rattling on the bar.

What is claimed is:

1. An electric resistance unit comprising an elongated support rod, the rod having a rectangular cross section with opposite side walls and opposite edges, a plurality of insulating refractory bodies on opposite edges of the rod in end-to-end abutment and arranged to substantially surround the rod, a continuous resistance winding helically mounted on and surrounding the refractory bodies, each body being a channel member having a slot to fit on the rod and having spaced legs extending over and along the opposite side walls, the corresponding legs of the channel members on opposite edges extending toward each other, flexible metal mounting means in the slot and between the rod and the bodies for retaining the bodies on the rod, and the flexible metal mounting means extending between the rod and said corresponding legs on at least one side wall of the rod.

2. The unit of claim 1 in which said mounting means is a metal strip.

3. The unit of claim 2 in which said strip has a nonplanar configuration.

4. The unit of claim 3 in which said strip has a sinuous configuration.

5. The unit of claim 4 in which said strip has a corrugated configuration having alternate ridges and grooves with the grooves adjacent to the support rod.

6. The unit of claim 5 in which the opposite ends of the ridges are inclined from the ends of adjacent grooves.

7. The unit of claim 4 in which the opposite ends of the ridges are beveled.

8. The unit of claim 7 in which the ridge ends are formed inward to provide inwardly inclined end portions to facilitate assembly of said bodies onto the rod.

9. The unit of claim 1 in which an adhesive is disposed between rod and the bodies.

10. The unit of claim 1 in which the metal strip comprises a multitude of lanced projections to hold the refractory bodies to the mounting bar by ratchet ction.

* * * * *